US008629735B2

(12) United States Patent
Mori et al.

(10) Patent No.: US 8,629,735 B2
(45) Date of Patent: Jan. 14, 2014

(54) ELECTRONIC COMPONENT

(71) Applicant: Murata Manufacturing Co., Ltd., Nagaokakyo (JP)

(72) Inventors: Takahiro Mori, Nagaokakyo (JP); Hiroshi Masuda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/721,144

(22) Filed: Dec. 20, 2012

(65) Prior Publication Data

US 2013/0106529 A1 May 2, 2013

Related U.S. Application Data

(63) Continuation of application No. PCT/JP2011/060957, filed on May 12, 2011.

(30) Foreign Application Priority Data

Jul. 6, 2010 (JP) ..... 2010-153994

(51) Int. Cl.
*H01P 5/12* (2006.01)
*H01P 3/08* (2006.01)

(52) U.S. Cl.
USPC ..... 333/109; 333/116

(58) Field of Classification Search
USPC ..... 333/109, 110, 112, 116, 238
See application file for complete search history.

(56) References Cited

U.S. PATENT DOCUMENTS

| | | | | |
|---|---|---|---|---|
| 5,359,304 | A | 10/1994 | Fujiki | |
| 5,557,245 | A * | 9/1996 | Taketa et al. | 333/116 |
| 5,742,210 | A | 4/1998 | Chaturvedi et al. | |
| 5,841,238 | A * | 11/1998 | Van Veldhuizen et al. | 315/119 |
| 6,686,812 | B2 * | 2/2004 | Gilbert et al. | 333/112 |
| 2005/0062557 | A1 | 3/2005 | Kang et al. | |
| 2009/0128255 | A1 | 5/2009 | Dupont et al. | |
| 2013/0120076 | A1 * | 5/2013 | Mori | 333/109 |

FOREIGN PATENT DOCUMENTS

| | | | |
|---|---|---|---|
| JP | 05-152814 | A | 6/1993 |
| JP | 08-191206 | A | 7/1996 |
| JP | 11-127005 | A | 5/1999 |
| JP | 2006-191221 | A | 7/2006 |

OTHER PUBLICATIONS

Official Communication issued in International Patent Application No. PCT/JP2011/060957, mailed on Jul. 26, 2011.

* cited by examiner

*Primary Examiner* — Dean O Takaoka
(74) *Attorney, Agent, or Firm* — Keating & Bennett, LLP

(57) ABSTRACT

In an electronic component, a main line includes a spiral-shaped portion having a central axis that is parallel or substantially parallel to a z-axis direction. A sub line is electromagnetically coupled with the main line to define a directional coupler, and includes a spiral-shaped portion having a central axis that is parallel or substantially parallel to the z-axis direction. Outer electrodes are provided on an end surface of a multilayer body and are respectively electrically connected to the two ends of the main line. Outer electrodes are provided on an end surface of the multilayer body and are respectively electrically connected to the two ends of the sub line. A region in which the main line is provided and a region in which the sub line is provided are superposed with each other in the z-axis stacking direction.

17 Claims, 10 Drawing Sheets

ELECTRONIC COMPONENT

BACKGROUND OF THE INVENTION

1. Field of the Invention

The present invention relates to electronic components and more specifically to electronic components including a built-in directional coupler.

2. Description of the Related Art

A chip-type directional coupler (hereafter, simply referred to as directional coupler) described in Japanese Unexamined Patent Application Publication No. 5-152814 is an example of a known electronic component of the related art. In this directional coupler, a multilayer structure is formed by stacking a plurality of rectangular electrode substrates on top of one another. In addition, a U-shaped stripline electrode which defines a main line (hereafter, simply referred to as a main line) and a U-shaped stripline electrode which defines a sub line (hereafter, simply referred to as a sub line) are provided on the electrode substrates. The main line is provided on a different electrode substrate than the sub line. That is, the main line and the sub line are arranged in the stacking direction. In addition, outer electrodes, to which the main line and sub line are connected, are provided on side surfaces of the multilayer structure.

There is a problem with the directional coupler described in Japanese Unexamined Patent Application Publication No. 5-152814 in that if an attempt is made to reduce the size of the directional coupler, manufacturing of the directional coupler becomes more difficult. In more detail, in the directional coupler, the outer electrodes are formed on the side surfaces of the multilayer structure. Accordingly, once a multilayer structure has been obtained by cutting a mother multilayer structure into pieces, the outer electrodes are formed on the multilayer structure by applying a conductive paste. Therefore, if the directional coupler is to be reduced in size, it is necessary to apply a conductive paste to a small multilayer structure and, therefore, it is difficult to form the outer electrodes.

In addition, there is a problem with the directional coupler described in Japanese Unexamined Patent Application Publication No. 5-152814 in that the degree of coupling between the main line and the sub line is relatively low. In more detail, the main line and the sub line are each provided on a single electrode substrate and coupled to each other in the stacking direction. Consequently, in order to increase the degree of coupling between the main line and the sub line, the layer between the main line and the sub line may be formed so as to be relatively thin so that the main line and sub line are as close to each other as possible. However, since there is a limit to how thin a dielectric layer can be made due to processing limitations, the degree of coupling between the main line and the sub line cannot be made sufficiently high.

SUMMARY OF THE INVENTION

To overcome the problems described above, preferred embodiments of the present invention provide an electronic component in which outer electrodes are easily formed and in which a main line and a sub line are coupled to each other with a high degree of coupling.

An electronic component according to a preferred embodiment of the present invention includes a multilayer body including a plurality of insulating layers that are stacked on top of one another, a main line including a first spiral-shaped portion having a first central axis that is parallel or substantially parallel to a stacking direction of the multilayer body, a sub line that is electromagnetically coupled to the main line such that a directional coupler is provided, and that includes a second spiral-shaped portion having a second central axis that is parallel or substantially parallel to the stacking direction, a first outer electrode and a second outer electrode that are provided on at least either one of end surfaces of the multilayer body disposed at opposed ends in the stacking direction and respectively electrically connected to two ends of the main line, and a third outer electrode and a fourth outer electrode that are provided on at least either one of the end surfaces of the multilayer body disposed at opposed ends in the stacking direction and respectively electrically connected to two ends of the sub line, wherein a first region in which the main line is provided and a second region in which the sub line is provided are superposed with each other in the stacking direction.

According to various preferred embodiments of present invention, outer electrodes are easily formed and a main line and a sub line are coupled to each other with a high degree of coupling.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, an electronic component according to various preferred embodiments of the present invention will be described.

Figure 1:
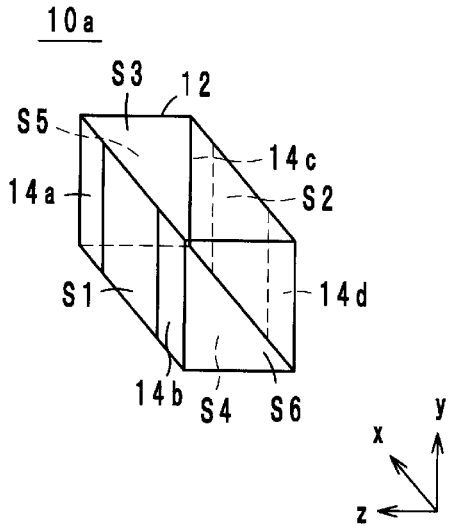
FIG. 1 is a perspective view of an electronic component according to a preferred embodiment of the present invention.
Figure 2:
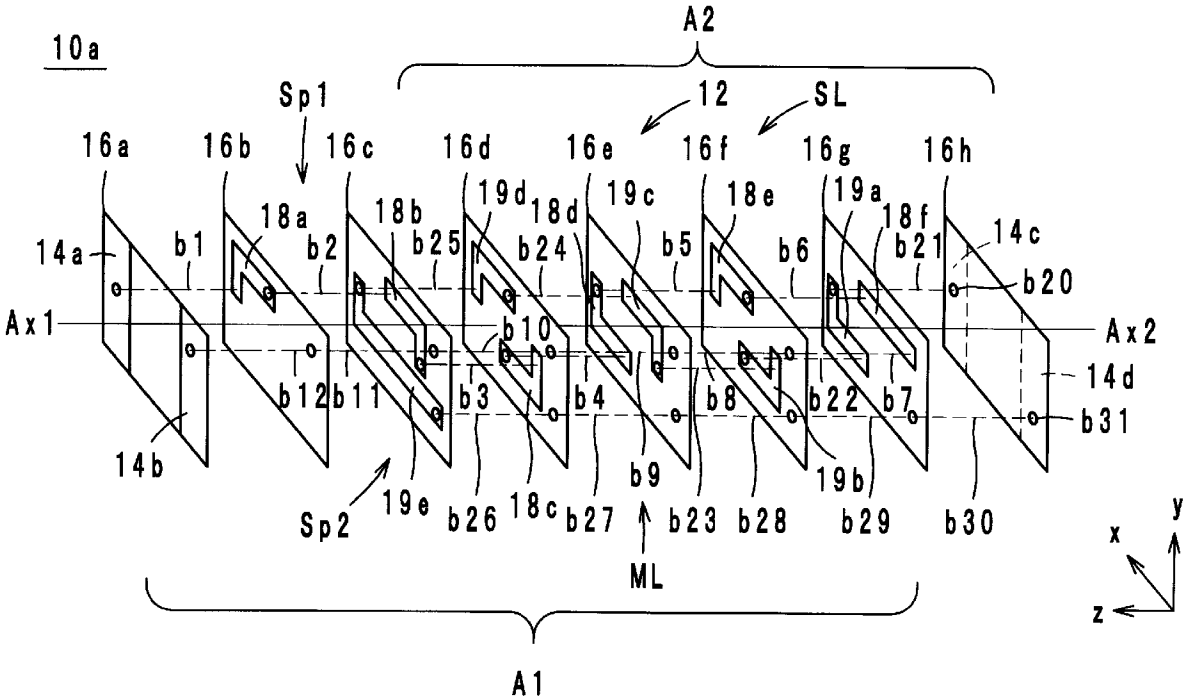
FIG. 2 is an exploded perspective view of the electronic component according to a preferred embodiment of the present invention.

Hereafter, the structure of an electronic component according to a preferred embodiment of the present invention will be described with reference to the drawings. FIG. 1 is a perspective view of an electronic component 10*a* according to a preferred embodiment. FIG. 2 is an exploded perspective view of the electronic component 10*a* according to the present preferred embodiment. A stacking direction of the electronic component 10*a* will be defined as a z-axis direction, and, when viewed in plan from the z-axis direction, a direction in which long sides of the electronic component 10*a* extend will be defined as an x-axis direction and a direction in which short sides of the electronic component 10*a* extend will be defined as a y-axis direction. The x-axis, the y-axis and the z-axis are perpendicular to one another.

As illustrated in FIG. 1 and FIG. 2, the electronic component 10*a* preferably includes a multilayer body 12, outer electrodes 14 (14*a* to 14*d*), a main line ML and a sub line SL.

As illustrated in FIG. 1, the multilayer body 12 preferably has a rectangular or substantially rectangular parallelepiped shape and the main line ML and the sub line SL are disposed therein. Surfaces of the multilayer body 12 that are respectively positioned on the positive side and the negative side in the z-axis direction are end surfaces S1 and S2. In addition, surfaces of the multilayer body 12 that are respectively positioned on the positive side and the negative side in the y-axis direction are a top surface S3 and a bottom surface S4. In addition, surfaces of the multilayer body 12 that are respectively positioned on the positive side and the negative side in the x-axis direction are side surfaces S5 and S6. Here, the bottom surface S4 is preferably a mount surface. That is, when the electronic component 10*a* is mounted on a circuit board, the bottom surface S4 faces a mount surface of the circuit board.

The multilayer body 12, as illustrated in FIG. 2, includes insulating layers 16 (16*a* to 16*h*) that are stacked on top of one another so as to be arranged in order from the positive side to the negative side in the z-axis direction. Thus, the multilayer body 12 is preferably mounted on a circuit board so that the z-axis direction is parallel or substantially parallel to the mount surface of the circuit board. The insulating layers 16 each preferably have a rectangular or substantially rectangular shape and are made of a dielectric material, for example. Hereafter, the surface of each insulating layer 16 on the positive side in the z-axis direction will be referred to as a front surface and the surface of each insulating layer 16 on the negative side in the z-axis direction will be referred to as a back surface.

The outer electrodes 14*a* and 14*b*, as illustrated in FIG. 2, are both provided on the end surface S1 of the multilayer body 12. That is, the outer electrodes 14*a* and 14*b* are provided on the front surface of the insulating layer 16*a*. The outer electrode 14*a* is positioned further towards the positive side in the x-axis direction than the outer electrode 14*b*. The outer electrodes 14*a* and 14*b* are only provided on the end surface S1 of the multilayer body 12 and are not provided on the top surface S3, the bottom surface S4, and the side surfaces S5 and S6 of the multilayer body 12.

In addition, the outer electrodes 14*c* and 14*d*, as illustrated in FIG. 2, are both provided on the end surface S2 of the multilayer body 12. That is, the outer electrodes 14*c* and 14*d* are provided on the back surface of the insulating layer 16*h*. The outer electrode 14*c* is positioned further towards the positive side in the x-axis direction than the outer electrode 14*d*. The outer electrodes 14*c* and 14*d* are only provided on the end surface S2 of the multilayer body 12 and are not provided on the top surface S3, the bottom surface S4, and the side surfaces S5 and S6 of the multilayer body 12.

The main line ML is connected between the outer electrodes 14*a* and 14*b* and, as illustrated in FIG. 2, includes a spiral-shaped portion Sp1 and via-hole conductors b1 and b7 to b12. The spiral-shaped portion Sp1 is preferably a signal line having a spiral shape that extends from the positive side toward the negative side in the z-axis direction while looping clockwise when viewed in plan from the positive side in the z-axis direction. That is, the spiral-shaped portion Sp1 has a central axis Ax1 that is parallel or substantially parallel to the z-axis direction. The spiral-shaped portion Sp1 includes signal conductors 18 (18*a* to 18*f*) and via-hole conductors b2 to b6.

The signal conductors 18 are preferably made of a conductive material and are configured such that line-shaped conductors thereof have a bent shape. Hereafter, when viewed in plan from the positive side in the z-axis direction, an end portion of each signal conductor 18 on the upstream side in the clockwise direction will be referred to as an upstream end and an end portion of each signal conductor 18 on the downstream side in the clockwise direction will be referred to as a downstream end.

The via-hole conductors b2 to b6 respectively penetrate through the insulating layers 16*b* to 16*f* in the z-axis direction and connect the signal conductors 18 to each other. In more detail, the via-hole conductor b2 connects a downstream end of the signal conductor 18*a* and an upstream end of the signal conductor 18*b* to each other. The via-hole conductor b3 connects a downstream end of the signal conductor 18*b* and an upstream end of the signal conductor 18*c* to each other. The via-hole conductor b4 connects a downstream end of the signal conductor 18*c* and an upstream end of the signal conductor 18*d* to each other. The via-hole conductor b5 connects a downstream end of the signal conductor 18*d* and an upstream end of the signal conductor 18*e* to each other. The via-hole conductor b6 connects a downstream end of the signal conductor 18*e* and an upstream end of the signal conductor 18*f* to each other.

The via-hole conductor b1, as illustrated in FIG. 2, penetrates through the insulating layer 16*a* in the z-axis direction and connects an end portion of the spiral-shaped portion Sp1 on the positive side in the z-axis direction (that is, an upstream end of the signal conductor 18*a*), and the outer electrode 14*a* to each other.

The via-hole conductors b7 to b12, as illustrated in FIG. 2, respectively penetrate through the insulating layers 16*f*, 16*e*, 16*d*, 16*c*, 16*b* and 16*a* in the z-axis direction and connect an end portion of the spiral-shaped portion Sp1 on the negative-side in the z-axis direction (that is, a downstream end of the signal conductor 18*f*) and the outer electrode 14*b* to each other. The via-hole conductors b7 to b12 are connected to one another so as to define a single via-hole conductor. As described above, the main line ML is electrically connected between the outer electrodes 14*a* and 14*b*. The main line ML, as illustrated in FIG. 2, is provided in a region A1 in which the insulating layers 16*a* to 16*g* are provided.

The sub line SL is connected between the outer electrodes 14*c* and 14*d* and is electromagnetically coupled with the main line ML such that a directional coupler is provided. The sub line SL, as illustrated in FIG. 2, includes a spiral-shaped portion Sp2 and via-hole conductors b20, b21 and b26 to b31.

The spiral-shaped portion Sp2 is preferably a signal line that has a spiral shape that extends from the negative side towards the positive side in the z-axis direction while looping counterclockwise when viewed in plan from the positive side in the z-axis direction. That is, the spiral-shaped portion Sp2 has a central axis Ax2 that is parallel or substantially parallel to the z-axis direction. The central axis Ax2, as illustrated in FIG. 2, coincides or substantially coincides with the central axis Ax1 when viewed in plan from the z-axis direction. Thus, the spiral-shaped portion Sp1 and the spiral-shaped portion Sp2 coincide or substantially coincide with and are superposed with each other when viewed in plan from the z-axis direction. The spiral-shaped portion Sp2 is defined by signal conductors 19 (19*a* to 19*e*) and via-hole conductors b22 to b25.

The signal conductors 19 are each preferably made of a conductive material and are configured such that line shaped conductors thereof have a bent shape. Hereafter, when viewed in plan from the positive side in the z-axis direction, an end portion of each signal conductor 19 on the upstream side in the counterclockwise direction will be referred to as an upstream end and an end portion of each signal conductor 19 on the downstream side in the counterclockwise direction will be referred to as a downstream end.

The via-hole conductors b22 to b25 respectively penetrate through the insulating layers 16*f*, 16*e*, 16*d* and 16*c* in the z-axis direction and connect the signal conductors 19 to one another. In more detail, the via-hole conductor b22 connects a downstream end of the signal conductor 19*a* and an upstream end of the signal conductor 19*b* to each other. The via-hole conductor b23 connects a downstream end of the signal conductor 19*b* and an upstream end of the signal conductor 19*c* to each other. The via-hole conductor b24 connects a downstream end of the signal conductor 19*c* and an upstream end of the signal conductor 19*d* to each other. The via-hole conductor b25 connects a downstream end of the signal conductor 19*d* and an upstream end of the signal conductor 19*e* to each other.

The via-hole conductors b20 and b21, as illustrated in FIG. 2, penetrate through the insulating layers 16*h* and 16*g* in the z-axis direction and connect an end portion of the spiral-shaped portion Sp2 on the negative side in the z-axis direction (that is, an upstream end of the signal conductor 19*a*) and the outer electrode 14*c* to each other. The via-hole conductors b20 and b21 are connected to each other so as to define a single via-hole conductor.

The via-hole conductors b26 to b31, as illustrated in FIG. 2, respectively penetrate through the insulating layers 16*h*, 16*g*, 16*f*, 16*e*, 16*d* and 16*c* in the z-axis direction and connect an end portion of the spiral-shaped portion Sp2 on the positive side in the z-axis direction (that is, a downstream end of the signal conductor 19*e*) and the outer electrode 14*d* to each other. The via-hole conductors b26 to b31 are connected to one another so as to define a single via-hole conductor. In this manner, the sub line SL is electrically connected between the outer electrodes 14*c* and 14*d*. The sub line SL, as illustrated in FIG. 2, is provided in a region A2 in which the insulating layers 16*c* to 16*h* are provided. Thus, the region A1 and the region A2 are superposed with each other in the z-axis direction.

In addition, in the electronic component 10*a*, the signal lines 18*b*, 18*c*, 18*d*, 18*e* and 18*f* and the signal conductors 19*e*, 19*d*, 19*c*, 19*b* and 19*a* are provided on the same insulating layers 16.

In the electronic component 10*a*, preferably, the outer electrode 14*a* is used as an input port, the outer electrode 14*b* is used as a main output port, the outer electrode 14*c* is used as a monitor output port and the outer electrode 14*d* is used as a 50 Ω termination port, for example.

Next, a non-limiting example of a method of manufacturing the electronic component 10*a* will be described while referring to FIG. 1 and FIG. 2.

First, ceramic green sheets that will become the insulating layers 16 are prepared. Next, the via-hole conductors b1 to b12 and b20 to b31 are formed in the ceramic green sheets that will become the insulating layers 16. When forming the via-hole conductors b1 to b12 and b20 to b31, via holes are formed by irradiating the ceramic green sheets that will become the insulating layers 16 with a laser beam. Next, the via holes are filled with a conductive paste preferably made of, for example, Ag, Pd, Cu, Au or an alloy of any of these metals using a method, such as printing.

Next, the signal conductors 18 and 19 are formed on the front surfaces of the ceramic green sheets that will become the insulating layers 16*b* to 16*g* by applying a conductive paste preferably including a main component of Ag, Pd, Cu, Au or an alloy of any of these metals, for example, by using a method, such a screen printing method or a photolithography method, for example. At the time of forming the signal conductors 18 and 19, filling of the via holes with a conductive paste may be performed.

In addition, the outer electrodes 14*a* to 14*d* are formed on the front surface of the ceramic green sheet that will become the insulating layer 16*a* and the back surface of the ceramic green sheet that will become the insulating layer 16*h* by applying a conductive paste preferably including a main component of Ag, Pd, Cu, Au or an alloy of any of these metals, for example, by using a method, such a screen printing method or a photolithography method, for example.

Next, the ceramic green sheets are stacked on top of one another. Specifically, the ceramic green sheets that will become the insulating layers 16*a* to 16*h* are stacked and press bonded together one at a time in order from the positive side to the negative side in the z-axis direction. A mother multilayer body is formed through the above-described steps. The mother multilayer body is subjected to permanent press bonding using, for example, a hydrostatic press.

Next, the multilayer body 12 having desired dimensions is obtained by cutting the mother multilayer body using a cutting blade. Thereafter, the yet-to-be-fired multilayer body 12 is subjected to de-binder treatment and is then fired.

A fired multilayer body 12 is obtained through the above-described steps. The multilayer body 12 is then subjected to barrel processing and chamfering.

Finally, Ni/Sn plating is performed on the front surfaces of the outer electrodes 14. The electronic component 10*a* illustrated in FIG. 1 is completed through the above-described steps.

In the electronic component 10*a*, the outer electrodes can be easily formed. In more detail, in the electronic component 10*a*, the outer electrodes 14 are provided on the end surfaces S1 and S2 of the multilayer body 12. Consequently, the outer electrodes 14 can be formed on the ceramic green sheets prior to stacking of the ceramic green sheets by using a method, such as screen printing, for example. That is, there is no need to form the outer electrodes 14 on a small post-cutting multilayer body 12. Consequently, the outer electrodes 14 can be easily formed.

In addition, in the electronic component 10*a*, it is possible for the main line ML and the sub line SL to be coupled to each other with a high degree of coupling. In more detail, in the electronic component 10*a*, as illustrated in FIG. 2, the region A1 in which the main line ML is provided and the region A2 in which the sub line SL is provided are superposed with each other in the z-axis direction. Consequently, the area in which the main line ML and the sub line SL are close to each other is relatively large. As a result, it is possible for the main line ML and the sub line SL to be coupled to each other with a high degree of coupling.

In addition, in the electronic component 10*a*, the central axis Ax1 and the central axis Ax2 are superposed with each other when viewed in plan from the z-axis direction. Consequently, most of the electric field and the magnetic field generated by the main line ML passes through the inside of the sub line SL and most of the electric field and the magnetic field generated by the sub line SL passes through the inside of the main line ML. As a result, the main line ML and the sub line SL are coupled to each other with a higher degree of coupling.

In addition, in the electronic component 10*a*, the signal conductors 18 that define the spiral-shaped portion Sp1 of the main line ML and the signal conductors 19 that define the spiral-shaped portion Sp2 of the sub line SL are preferably provided on the same insulating layers. Therefore, stray capacitances between the signal conductors 18 and 19 are greatly reduced. Consequently, capacitive coupling of the signal conductors 18 and the signal conductors 19 and deterioration of isolation characteristics are effectively prevented.

Figure 3:
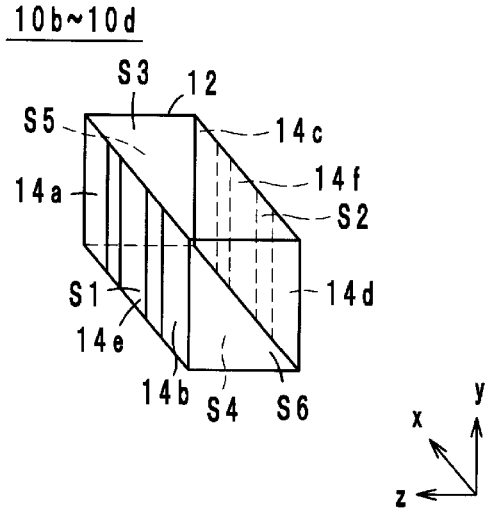
FIG. 3 is an external perspective view of an electronic component according to modifications of a preferred embodiment of the present invention.
Figure 4:
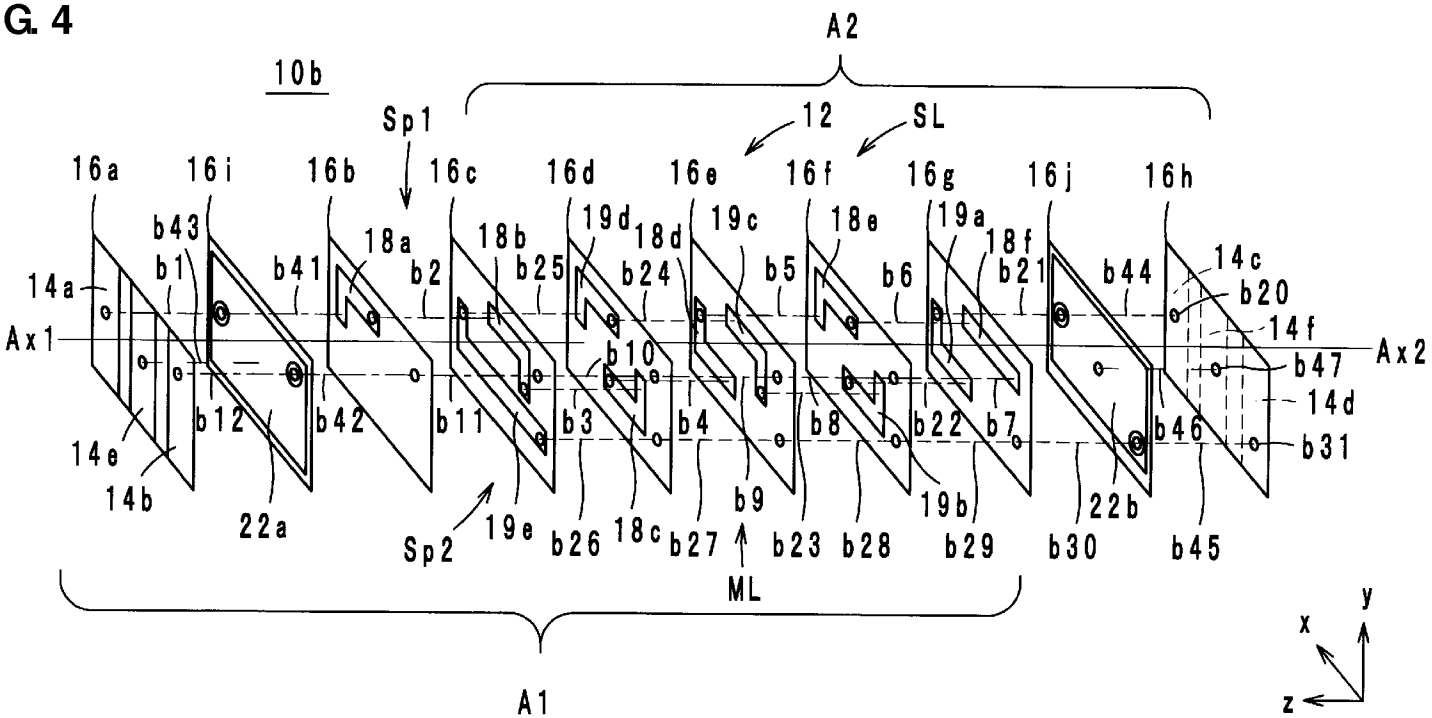
FIG. 4 is an exploded perspective view of an electronic component according to a first modification of a preferred embodiment of the present invention.

Hereafter, an electronic component 10*b* according to a first modification of a preferred embodiment of the present invention will be described with reference to the drawings. FIG. 3 is an external perspective view of electronic components 10*b* to 10*d* according to various modifications. FIG. 4 is an exploded perspective view of the electronic component 10*b* according to the first modification.

In the electronic component 10*a*, the outer electrodes 14*a* to 14*d* are provided on the multilayer body 12. In contrast, in the electronic component 10*b*, as illustrated in FIG. 3, outer electrodes 14*e* and 14*f* are provided in addition to the outer electrodes 14*a* to 14*d*.

In addition, in the electronic component 10*a*, only the main line ML and the sub line SL are provided inside the multilayer body 12. In contrast, in the electronic component 10*b*, as illustrated in FIG. 4, ground conductors 22 (22*a*, 22*b*) are provided inside the multilayer body 12, in addition to the main line ML and the sub line SL.

The outer electrode 14*e* is arranged so as to be interposed between the outer electrodes 14*a* and 14*b* on the end surface S1. The outer electrode 14*f* is arranged so as to be interposed between the outer electrodes 14*c* and 14*d* on the end surface S2.

An insulating layer 16*i* is provided between the insulating layer 16*a* and the insulating layer 16*b*. Via-hole conductors b41 and b42 are provided in the insulating layer 16*i*. The via-hole conductor b41 connects the via-hole conductor b1 and the via-hole conductor b2 to each other. The via-hole conductor b42 connects the via-hole conductor b11 and the via-hole conductor b12 to each other.

In addition, the ground conductor 22*a* preferably has a rectangular or substantially rectangular shape and is provided on the front surface of the insulating layer 16*i*. The ground conductor 22*a* is connected to the outer electrode 14*e* via a via-hole conductor b43 provided in the insulating layer 16*a*. However, the ground conductor 22*a* is insulated from the via-hole conductors b41 and b42.

An insulating layer 16*j* is provided between the insulating layer 16*g* and the insulating layer 16*h*. Via-hole conductors b44 and b45 are provided in the insulating layer 16*j*. The via-hole conductor b44 connects the via-hole conductor b20 and the via-hole conductor b21 to each other. The via-hole conductor b45 connects the via-hole conductor b30 and the via-hole conductor b31 to each other.

In addition, the ground conductor 22*b* preferably has a rectangular or substantially rectangular shape and is provided on the front surface of the insulating layer 16*j*. The ground conductor 22*b* is connected to the outer electrode 14*f* via via-hole conductors b46 and b47 provided in the insulating layers 16*j* and 16*h*. However, the ground conductor 22*b* is insulated from the via-hole conductors b44 and b45.

In the electronic component 10*b*, preferably the outer electrode 14*a* is used as an input port, the outer electrode 14*b* is used as a main output port, the outer electrode 14*c* is used as a monitor output port, the outer electrode 14*d* is used as a 50 Ω termination port, and the outer electrodes 14*e* and 14*f* are used as ground ports, for example.

In the electronic component 10*b*, the spiral-shaped portions Sp1 and Sp2 are interposed between the ground conductors 22*a* and 22*b* on either side in the z-axis direction. Consequently, intrusion of noise to the spiral-shaped portions Sp1 and Sp2 is prevented or minimized.

In addition, the impedances of the main line ML and the sub line SL can be set to desired values by adjusting the distance between the ground conductor 22*a* and the spiral-shaped portion Sp1 and the distance between the ground conductor 22*b* and the spiral-shaped portion Sp2, respectively.

Figure 5:
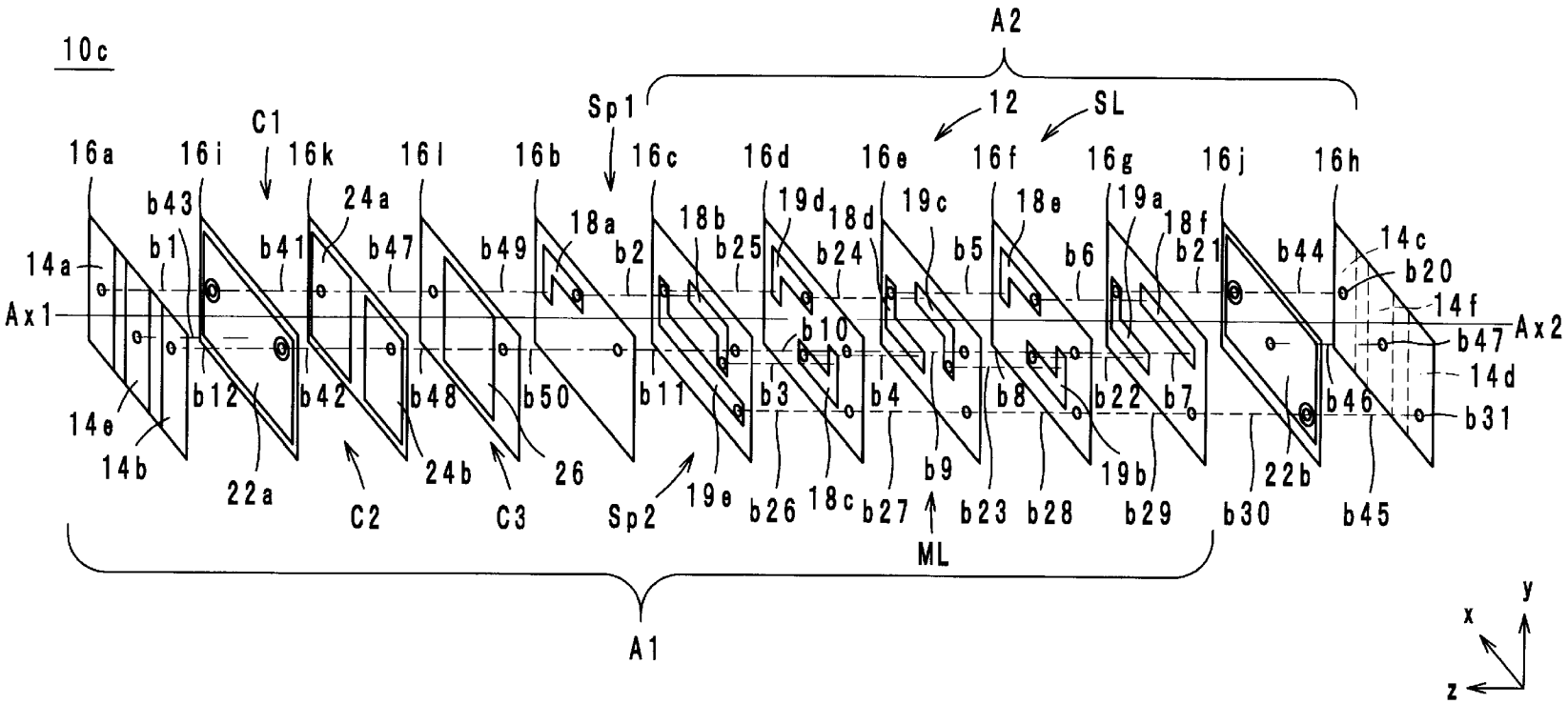
FIG. 5 is an exploded perspective view of an electronic component according to a second modification of a preferred embodiment of the present invention.
Figure 6:
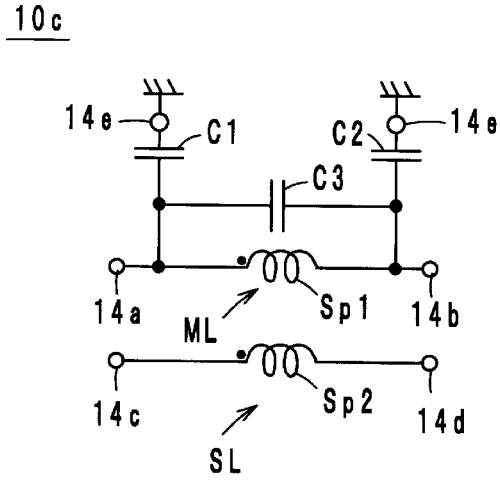
FIG. 6 is a circuit diagram of the electronic component according to the second modification of a preferred embodiment of the present invention.

Hereafter, an electronic component 10*c* according to a second modification of a preferred embodiment of the present invention will be described with reference to the drawings. FIG. 5 is an exploded perspective view of the electronic component 10*c* according to the second modification. FIG. 6 is circuit diagram of the electronic component 10*c* according to the second modification.

In the electronic component 10*b*, only the main line ML, the sub line SL, and the ground conductors 22 are provided inside the multilayer body 12. In contrast, in the electronic component 10*c*, as illustrated in FIG. 5 and FIG. 6, capacitors C1 to C3 are provided inside the multilayer body 12, in addition to the main line ML, the sub line SL, and the ground conductors 22.

Insulating layers 16*k* and 16*l* are provided between the insulating layer 16*i* and the insulating layer 16*b*. Via-hole conductors b47 and b48 are provided in the insulating layer 16*k*. Via-hole conductors b49 and b50 are provided in the insulating layer 16*l*. The via-hole conductors b47 and b49 connect the via-hole conductor b41 and the via-hole conductor b2 to each other. The via-hole conductors b48 and b50 connect the via-hole conductor b42 and the via-hole conductor b11 to each other.

Capacitor conductors 24*a* and 24*b* are provided on the front surface of the insulating layer 16*k*. The capacitor conductors 24*a* and 24*b* face the ground conductor 22*a* such that the capacitors C1 and C2 are respectively defined. In addition, the capacitor conductors 24*a* and 24*b* are respectively connected to the via-hole conductors b41 and b42. In this manner, the capacitors C1 and C2 are connected between the two ends of the spiral-shaped pattern Sp1 and the outer electrode 14*e*.

A capacitor conductor 26 is provided on the front surface of the insulating layer 16*l*. The capacitor conductor 26 faces the capacitor conductors 24*a* and 24*b* and thereby the capacitor C3 is defined. In this manner, the capacitor C3, as illustrated in FIG. 6, is connected in parallel with the spiral-shaped portion Sp1.

The above-described capacitors C1 to C3 define a π type low-pass filter. Thus, noise generated by the main line ML is effectively prevented or minimized.

Figure 7:
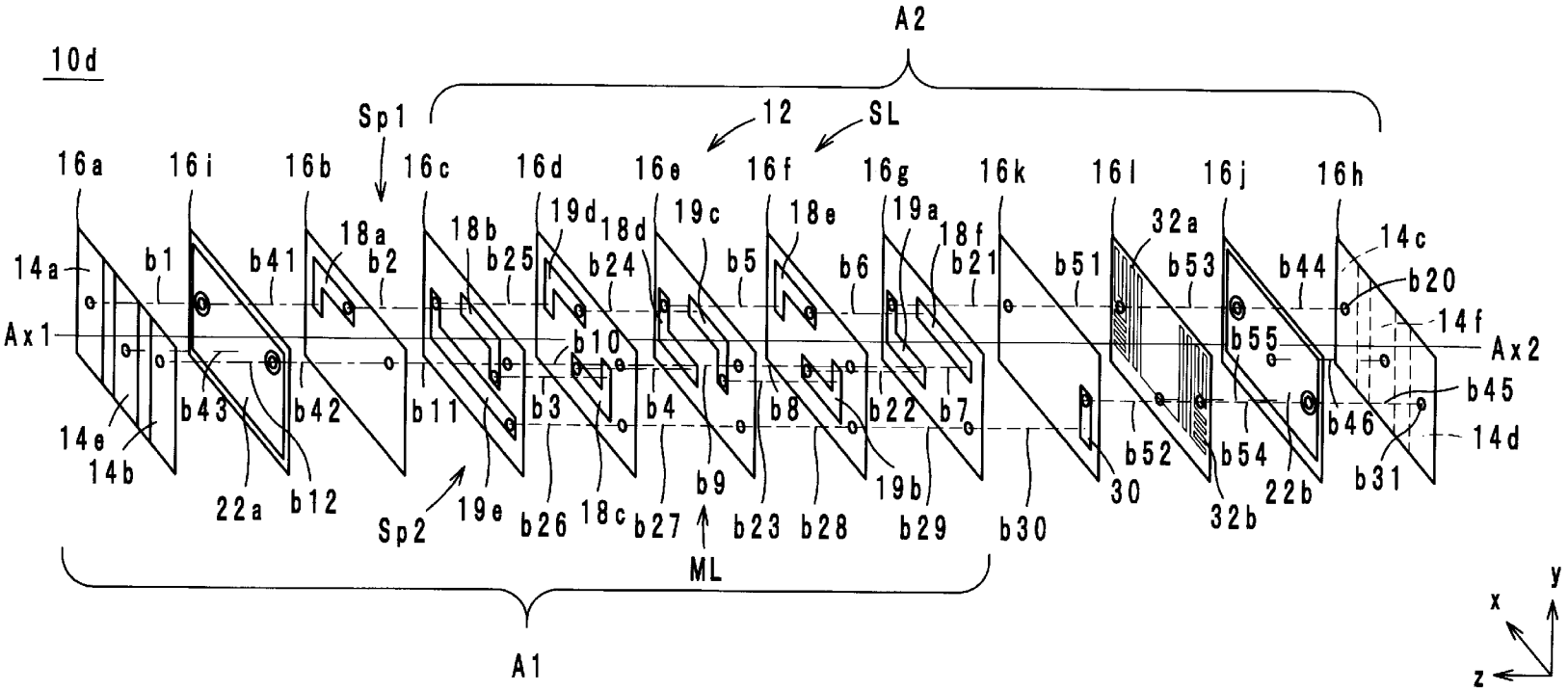
FIG. 7 is an exploded perspective view of an electronic component according to a third modification of a preferred embodiment of the present invention.
Figure 8:
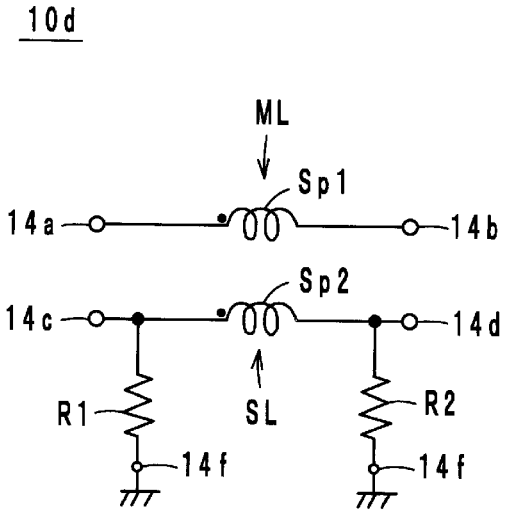
FIG. 8 is a circuit diagram of the electronic component according to the third modification of a preferred embodiment of the present invention.

Hereafter, an electronic component 10*d* according to a third modification of a preferred embodiment of the present invention will be described with reference to the drawings. FIG. 7 is an exploded perspective view of the electronic component 10*d* according to the third modification. FIG. 8 is a circuit diagram of the electronic component 10*d* according to the third modification.

In the electronic component 10*b*, only the main line ML, the sub line SL, and the ground conductors 22 are provided inside the multilayer body 12. In contrast, in the electronic component 10*d*, as illustrated in FIG. 7 and FIG. 8, resistors R1 and R2 are provided inside the multilayer body 12, in addition to the main line ML, the sub line SL, and the ground conductors 22.

Insulating layers 16*k* and 16*l* are provided between the insulating layer 16*g* and the insulating layer 16*j*. Via-hole conductors b51 and b52 and a connection conductor 30 are provided in and on the insulating layer 16*k*. Via-hole conductors b53 and b54 are provided in the insulating layer 16*l*. The via-hole conductors b51 and b53 connect the via-hole conductor b21 and the via-hole conductor b44 to each other. The via-hole conductors b52 and b54 and the connection conductor 30 connect the via-hole conductor b30 and the via-hole conductor b45 to each other.

Resistor conductors 32*a* and 32*b*, which define the resistors R1 and R2, are provided on the front surface of the insulating layer 16*l*. The resistor conductors 32*a* and 32*b* are preferably made of a high-resistance material and have a meandering shape, for example. One end of the resistor conductor 32*a* and one end of the resistor conductor 32*b* are respectively connected to the via-hole conductors b51 and b52. The other ends of the resistor conductors 32*a* and 32*b* are connected to each other. The other ends of the resistor conductors 32*a* and 32*b* are connected to the ground conductor 22*b* via a via-hole conductor b55 provided in the insulating layer 16. In this manner, the resistors R1 and R2 are respectively provided between the two ends of the spiral-shaped portion Sp2 and the outer electrode 14*f*.

A portion through which the outer electrode 14*c* and the sub line SL are connected to each other is connected to a ground electrode 14*f* via the resistor R1 and a portion through which the outer electrode 14*d* and the sub line SL are connected to each other is connected to the ground electrode 14*f* via the resistor R2. Here, the resistors R1 and R2 function as attenuators and signals output from the monitor output port and the 50 Ω termination port are effectively attenuated to desired values.

Figure 9:
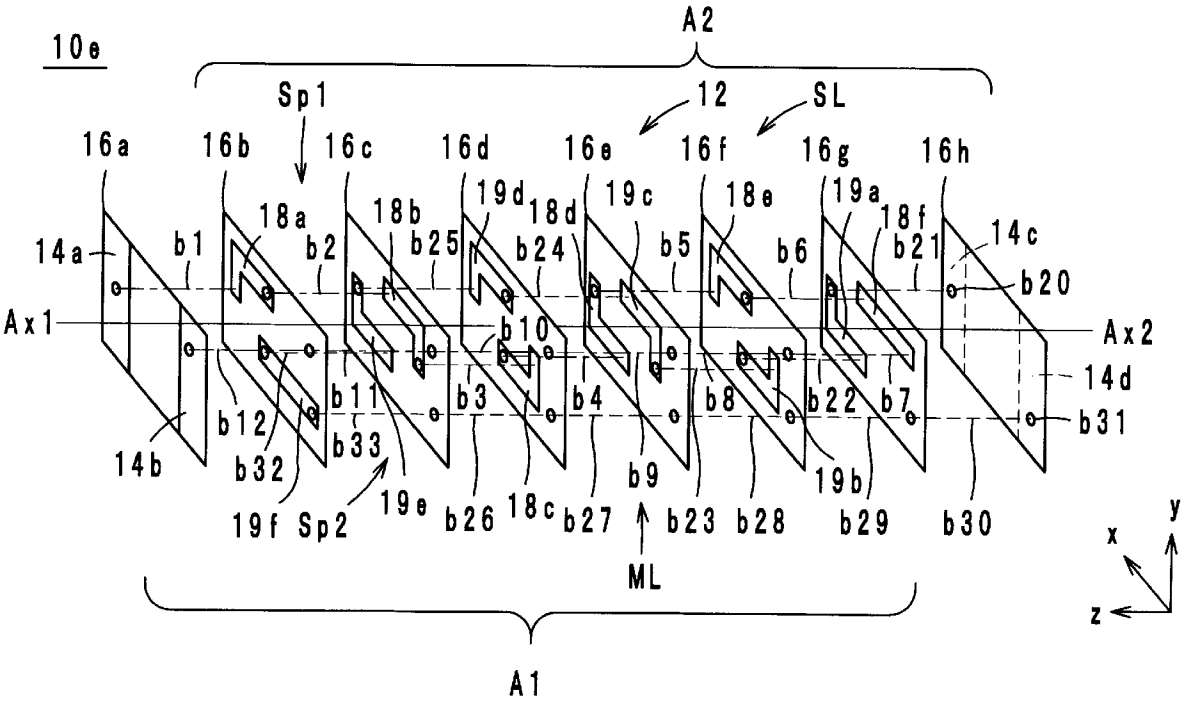
FIG. 9 is an exploded perspective view of an electronic component according to a fourth modification of a preferred embodiment of the present invention.

Hereafter, an electronic component 10*e* according to a fourth modification of a preferred embodiment of the present invention will be described with reference to the drawings. FIG. 9 is an exploded perspective view of the electronic component 10*e* according to the fourth modification.

In the electronic component 10*e*, a signal conductor 19*f* and via-hole conductors b32 and b33 are added to the electronic component 10*a*. The signal conductor 19*f* is a line-shaped conductor that defines a portion of the sub line SL and is provided on the insulating layer 16*b*. That is, the signal conductor 19*f* is provided on the same insulating layer 16*b* as the signal conductor 18*a*.

Hereafter, when viewed in plan from the positive side in the z-axis direction, an end portion of each signal conductor 19 on the upstream side in the counterclockwise direction will be referred to as an upstream end and an end portion of each signal conductor 19 on the downstream side in the counterclockwise direction will be referred to as a downstream end. The via-hole conductors b32 and b33 penetrate through the insulating layer 16*b* in the z-axis direction. The via-hole conductor b32 connects a downstream end of the signal conductor 19*e* and an upstream end of the signal conductor 19*f* to each other. The via-hole conductor b33 connects a downstream end of the signal conductor 19*f* and the via-hole conductor b26 to each other.

As described above, the signal conductors 18*a*, 18*b*, 18*c*, 18*d*, 18*e* and 18*f* and the signal conductors 19*f*, 19*e*, 19*d*, 19*c*, 19*b* and 19*a* are preferably provided on the same insulating layers 16. That is, in the electronic component 10*e*, signal conductors 19 are preferably provided on all of the insulating layers 16 on which signal conductors 18 are provided.

In the electronic component 10*e*, signal conductors 19 are preferably provided on all of the insulating layers 16 on which signal conductors 18 are provided. Therefore, the main line ML and the sub line SL are coupled to each other with a higher degree of coupling.

Figure 10:
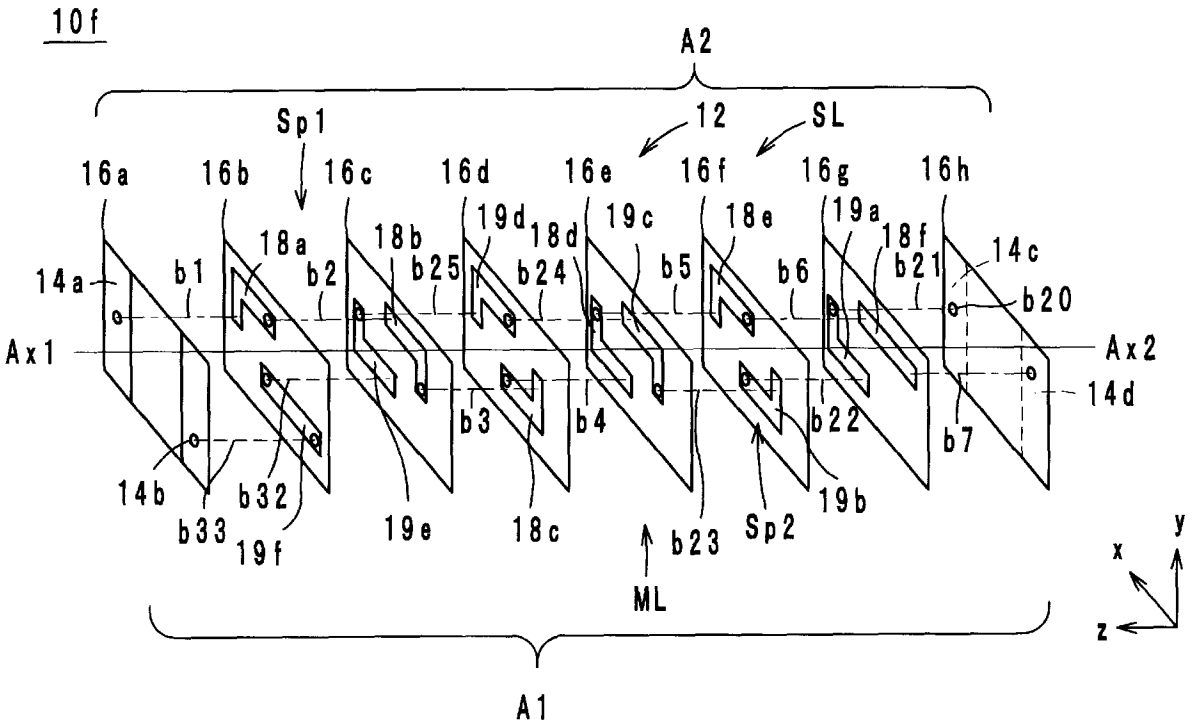
FIG. 10 is an exploded perspective view of an electronic component according to a fifth modification of a preferred embodiment of the present invention.

Hereafter, an electronic component 10*f* according to a fifth modification of a preferred embodiment of the present invention will be described with reference to the drawings. FIG. 10 is an exploded perspective view of the electronic component 10*f* according to the fifth modification.

In the electronic component 10*f*, the two ends of the main line ML are respectively connected to the outer electrodes 14*a* and 14*d*. In addition, the two ends of the sub line SL are respectively connected to the outer electrodes 14*b* and 14*c*. That is, in the electronic component 10*f*, the two ends of the main line ML and the two ends of the sub line SL extend to the mutually opposing end surfaces S1 and S2.

By configuring the outer electrodes 14*a* to 14*d* of the electronic component 10*f* in this manner, the number of ways in which the electronic component 10*f* can be connected to a circuit board is increased while continuing to maintain a high degree of coupling. Consequently, the degree of freedom in designing the circuit board is increased.

The electronic components 10*a* to 10*f* described in the preferred embodiments are not limited to the described configurations and can be modified within the scope of the present invention.

In the electronic components 10*a* to 10*f*, the central axes Ax1 and Ax2 preferably coincide or substantially coincide with and are superposed with each other when viewed in plan from the z-axis direction. However, the central axes Ax1 and Ax2 need not coincide or substantially coincide with and be superposed with each other. For example, by not having the central axes Ax1 and Ax2 coincide or substantially coincide with each other when viewed in plan from the z-axis direction, but by rather adjusting the distance between the central axes Ax1 and Ax2, the degree of coupling between the sub line SL and the main line ML may be freely adjusted to a desired state. However, it is also preferable in this case that the spiral-shaped portions Sp1 and Sp2 be superposed with each other when viewed in plan from the z-axis direction.

In addition, preferably, the outer electrodes 14*a* and 14*b* are provided on the end surface S1 and the outer electrodes 14*c* and 14*d* are provided on the end surface S2, but the arrangement of the outer electrodes 14*a* to 14*d* is not limited to this. At least one of the outer electrodes 14*a* and 14*b* may be provided on the end surface S2 and at least one of the outer electrodes 14*c* and 14*d* may be provided on the end surface S1. As described above, preferred embodiments of the present invention are useful in electronic components and are particularly excellent in that outer electrodes can be easily formed and a main line and a sub line are coupled to each other with a high degree of coupling.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electronic component comprising:

a multilayer body including a plurality of insulating layers stacked on top of one another;

a main line including a first spiral-shaped portion having a first central axis that is parallel or substantially parallel to a stacking direction of the multilayer body;

a sub line electromagnetically coupled to the main line to define a directional coupler and including a second spiral-shaped portion having a second central axis that is parallel or substantially parallel to the stacking direction;

a first outer electrode and a second outer electrode provided on at least either one of end surfaces of the multilayer body positioned at opposed ends in the stacking direction and respectively electrically connected to two ends of the main line; and a third outer electrode and a fourth outer electrode provided on at least either one of the end surfaces of the multilayer body positioned at the opposed ends in the stacking direction and respectively electrically connected to two ends of the sub line; wherein a first region in which the main line is provided and a second region in which the sub line is provided are superposed with each other in the stacking direction;

the first outer electrode and the second outer electrode are provided on one end surface of the multilayer body; and the third outer electrode and the fourth outer electrode are provided on another end surface of the multilayer body.

2. The electronic component according to claim 1, wherein the first spiral-shaped portion and the second spiral-shaped portion are superposed with each other when viewed in plan from the stacking direction.

3. The electronic component according to claim 2, wherein the first central axis and the second central axis are superposed with each other when viewed in plan from the stacking direction.

4. The electronic component according to claim 1, further comprising:

a fifth outer electrode provided on one of the one end surface and the another end surface of the multilayer body; and a first capacitor and a second capacitor respectively connected between two ends of the first spiral-shaped portion and the fifth outer electrode.

5. The electronic component according to claim 1, further comprising:

a sixth outer electrode provided on one of the one end surface and the another end surface of the multilayer body; and a first resistor and a second resistor respectively connected between two ends of the second spiral-shaped portion and the sixth outer electrode.

6. The electronic component according to claim 1, wherein the first spiral-shaped portion is defined by a first signal conductor and a first via-hole conductor connected to each other;

the second spiral-shaped portion is defined by a second signal conductor and a second via-hole conductor connected to each other; and at least a portion of the first signal conductor and at least a portion of the second signal conductor are provided on the same insulating layer of the plurality of insulating layers.

7. The electronic component according to claim 1, wherein the electronic component is mounted on a circuit board such that the stacking direction of the plurality of insulating layers and a mount surface of the circuit board are parallel or substantially parallel to each other.

8. An electronic component comprising:

a multilayer body including a plurality of insulating layers stacked on top of one another;

a main line having a first central axis that is parallel or substantially parallel to a stacking direction of the multilayer body;

a sub line electromagnetically coupled to the main line to define a directional coupler and having a second central axis that is parallel or substantially parallel to the stacking direction;

a first outer electrode and a second outer electrode provided on at least either one of end surfaces of the multilayer body positioned at opposed ends in the stacking direction and respectively electrically connected to two ends of the main line; and a third outer electrode and a fourth outer electrode provided on at least either one of the end surfaces of the multilayer body positioned at the opposed ends in the stacking direction and respectively electrically connected to two ends of the sub line; wherein a first region in which the main line is provided and a second region in which the sub line is provided are superposed with each other in the stacking direction;

the first outer electrode and the second outer electrode are provided on one end surface of the multilayer body; and the third outer electrode and the fourth outer electrode are provided on another end surface of the multilayer body.

9. The electronic component according to claim 8, wherein the main line includes a first spiral-shaped portion.

10. The electronic component according to claim 8, wherein the sub line includes a second spiral-shaped portion.

11. The electronic component according to claim 8, wherein the main line includes a first spiral-shaped portion and the sub line includes a second spiral-shaped portion.

12. The electronic component according to claim 11, wherein the first spiral-shaped portion and the second spiral-shaped portion are superposed with each other when viewed in plan from the stacking direction.

13. The electronic component according to claim 12, wherein the first central axis and the second central axis are superposed with each other when viewed in plan from the stacking direction.

14. The electronic component according to claim 8, further comprising:

a fifth outer electrode provided on one of the one end surface and the another end surface of the multilayer body; and a first capacitor and a second capacitor respectively connected between two ends of the main line and the fifth outer electrode.

15. The electronic component according to claim 8, further comprising:

a sixth outer electrode provided on one of the one end surface and the another end surface of the multilayer body; and a first resistor and a second resistor respectively connected between two ends of the sub line and the sixth outer electrode.

16. The electronic component according to claim 11, wherein the first spiral-shaped portion is defined by a first signal conductor and a first via-hole conductor connected to each other;

the second spiral-shaped portion is defined by a second signal conductor and a second via-hole conductor connected to each other; and at least a portion of the first signal conductor and at least a portion of the second signal conductor are provided on the same insulating layer of the plurality of insulating layers.

17. The electronic component according to claim 8, wherein the electronic component is mounted on a circuit board such that the stacking direction of the plurality of insulating layers and a mount surface of the circuit board are parallel or substantially parallel to each other.

* * * * *